US006805194B2

(12) United States Patent
Davidson et al.

(10) Patent No.: US 6,805,194 B2
(45) Date of Patent: Oct. 19, 2004

(54) GAS AND OIL PRODUCTION

(75) Inventors: Ian David Farquhar Davidson, Aberdeen (GB); Andrew George Yule, Blairs (GB)

(73) Assignee: Scotoil Group Plc, Aberdeen (GB)

( * ) Notice: Subject to any disclaimer, the term of this patent is extended or adjusted under 35 U.S.C. 154(b) by 0 days.

(21) Appl. No.: 10/273,449

(22) Filed: Oct. 18, 2002

(65) Prior Publication Data

US 2003/0070804 A1 Apr. 17, 2003

Related U.S. Application Data

(63) Continuation of application No. PCT/GB01/01794, filed on Apr. 20, 2001.

(30) Foreign Application Priority Data

Apr. 20, 2000 (GB) ..... 0009662

(51) Int. Cl.[7] ..... E21B 43/24; E21B 43/30; E21B 47/09

(52) U.S. Cl. ..... 166/245; 166/50; 166/254.2; 166/263; 166/302

(58) Field of Search ..... 166/50, 60, 245, 166/256, 257, 263, 302, 254.2, 248

(56) References Cited

U.S. PATENT DOCUMENTS

| | | | | | |
|---|---|---|---|---|---|
| 849,524 | A | | 4/1907 | Baker | |
| 2,186,035 | A | | 1/1940 | Niles | 166/21 |
| 2,795,279 | A | | 6/1957 | Sarapuu | 166/11 |
| 2,818,118 | A | | 12/1957 | Dixon | 166/11 |
| 3,106,244 | A | | 10/1963 | Parker | 166/11 |
| 3,428,125 | A | | 2/1969 | Parker | 166/248 |
| 3,870,481 | A | | 3/1975 | Hegarty | 48/213 |
| 4,003,441 | A | * | 1/1977 | Lokshin et al. | 175/71 |
| 4,183,405 | A | * | 1/1980 | Magnie | 166/260 |
| 4,382,469 | A | | 5/1983 | Bell et al. | 43/24 |
| 4,386,657 | A | * | 6/1983 | Kiss et al. | 166/261 |
| 4,435,016 | A | * | 3/1984 | Wissenberg et al. | 299/2 |
| 4,524,827 | A | | 6/1985 | Bridges et al. | 166/248 |
| 4,912,971 | A | | 4/1990 | Jeambey | 73/151 |
| 4,928,765 | A | | 5/1990 | Nielson | 166/251 |

FOREIGN PATENT DOCUMENTS

| | | | |
|---|---|---|---|
| GB | 1595082 | 11/1977 | 43/18 |
| WO | WO 98/58156 | 12/1998 | 43/24 |

* cited by examiner

*Primary Examiner*—George Suchfield
(74) *Attorney, Agent, or Firm*—Heslin Rothenberg Farley & Mesiti P.C.

(57) ABSTRACT

A process for in situ gasification of mineral oil in a subterranean formation comprises running a tool having a controllable thermal device therein from a surface production facility down to the subterranean formation, bringing said tool into operational proximity with the mineral oil in said subterranean formation, and activating the tool to operate the thermal device within a predetermined temperature range to generate gases or oily vapours from said mineral oil, which permits either an enhanced oil recovery (EOR) method with reduced water contamination, or a gas production process (GPP) which is useful in reducing environmental risks normally associated with transport of crude oil.

12 Claims, 4 Drawing Sheets

GAS AND OIL PRODUCTION

This application is a continuation of PCT/GB01/01794, filed Apr. 20, 2001, which international application was published under PCT Article 21(2) in English.

FIELD OF THE INVENTION

This invention relates to techniques for enhancing oil recovery from ageing fields or low-pressure reservoirs. In particular the invention offers developments in gasification processes adapted to assist in driving oil from subterranean formations, or in converting said oil to useful gaseous products.

BACKGROUND TO THE INVENTION

The process of gasification of subterranean carbonaceous fossil residues such as coal, lignite, oil shale, tar sands, and heavy oils in fields where recovery is difficult due to insufficient pressure to drive the oil to the surface, has been described in the literature and some processes have been operated commercially.

An in situ gasification process to be applied to an underground formation of carbonaceous material is described in U.S. Pat. No. 4,382,469. In the proposed process, a controlled direct current is passed through the formation. That reference also mentions several other prior art gasification methods which are described in U.S. Pat. Nos. 849,524, 2,818,118, 2,795,279, 3,106,244, 3,428,125. These methods generally have the same objective i.e. volatilisation or pyrolysis of the carbonaceous material to drive off gaseous hydrocarbon products, i.e. fuel gas.

A further in situ gasification of subterranean carbonaceous deposits is described in U.S. Pat. No. 4,461,349, wherein a pattern of bore holes is formed to provide in parallel a row of gas injection wells and a row of production wells. Oxygen containing gas is injected into the subterranean coal field to enable a combustion front driving a resultant gasification of the coal to be formed. The front drives the gas formed by thermal conversion of the carbonaceous deposit towards the production wells where thermocouples or the like detectors may be relied on to trigger a shut-down procedure to prevent combustion at or in the production wells. The process described there is said to be particularly suited to the recovery of gasification products from subterranean coal deposits.

Details of various coal gasification and liquefaction processes may be found in the Encyclopaedia of Chemical Technology, Kirk-Othmer, 3$^{rd}$ Edition (1980) Volume 11, pages 410–422 and 449–473.

In relation to oil (petroleum) recovery, depleted wells or low natural drive reservoirs may be worked by the process of secondary recovery which involves enhancing or inducing a drive in the reservoir by water flooding or in situ combustion. The latter process in elementary form involves lowering an igniter into a bore hole and triggering an ignition of the hydrocarbons in the target reservoir. Although lighter hydrocarbons are consumed in the combustion, the resulting thermal front lowers the viscosity of the heavier deposits and drives them through the formation to a recovery well. Other methods, the so-called tertiary recovery methods, including steam injection, air injection, displacement by polymer introduction, explosive fracturing, hydraulic fracturing, carbon dioxide injection, chemical processes including introduction of caustics have all been proposed for use.

Currently, the industry has available secondary recovery methods that can be classified broadly as "Gas injection", "Water Flooding", and "Thermal Recovery".

"Gas Injection" techniques inject a gas, such as nitrogen or carbon dioxide, into the target formation to elevate pressure upon the residual oil and facilitate production thereof.

"Thermal Recovery" techniques require injection of an air/oxygen mixture into the formation toward a heating element at the base of the string. Whenever the critical conditions of air/oil and heat are reached the oil ignites and produces a combustion front. The front is driven in the desired direction by continuing the supply of combustion-supporting gas at a controlled pressure to avoid burn-back. As the combustion front progresses through the oil reservoir, oil and formation water are vaporised, driven forward in the gaseous phase and re-condensed in the cooler section of the formation, in turn the condensed fluids displace oil into the production well bores.

"Gasification" processes of the known types can be distinguished by the end product to be recovered. One approach to gasification, subjects the ageing field to a method of gasification of the residual oil so that the resulting gas can be collected, i.e. the gas rather than the residual oil becomes the target product. Another approach relies on the gas produced in the gasification process to act as a fuel in a combustion process (c.f. discussion on thermal recovery above) to displace residual oil to allow it to be retrieved from the formation, i.e. the gas is only a means to enhance recovery of the oil which remains the target product. The latter is a true enhanced oil recovery method (EOR) whereas the former is a gas-producing process (GPP) wherein the oil is volatilised and thermally cracked to gases which are captured and transported to the surface for processing.

In order for the GPP process to be successful, the produced gas must be captured readily, and fields where highly porous formations are situated above the oil would be considered unsuitable for this approach.

An EOR process is only effective if the residual oil deposits are not so heavy as to make flow difficult, and do not contain significant levels of high molecular weight paraffins and waxes which would inhibit flow. Furthermore, the known thermal recovery processes may not perform satisfactorily due to a declining temperature gradient around the igniter which can lead to heavy fractions in the oil consolidating at a distance from the igniter and thus clogging the formation to prevent effective recovery.

SUMMARY OF THE INVENTION

An object of the present invention is to provide improvements in or relating to the recovery of oil from partially depleted or ageing "weak drive" fields and formations where gasification of residual oil is a potential solution.

A further object of the present invention is to provide an apparatus for in situ gasification of oil to produce a synthetic gas "syngas" within the reservoir. An aim in developing such an apparatus is to provide a tool adapted to be readily launched into the reservoir using existing well access or requiring minimal adaptations thereof.

A still further object of the present invention is to provide a method of secondary recovery or enhanced oil recovery offering advantages over prior art proposals.

Yet another object of the present invention is to provide according to one aspect a gasification process to be performed on the production platform.

Further objectives of the present invention include the provision of methods of gas production and oil recovery, which obviate or mitigate problems evident or inherent in known methods.

Thus according to the present invention there is provided a process for in situ gasification of mineral oil in a subterranean formation which comprises running a tool having a controllable thermal device therein from a surface production facility down to the subterranean formation, bringing said tool into operational proximity with the mineral oil in said subterranean formation, and activating the tool to operate the thermal device within a predetermined temperature range to generate gases or oily vapours from said mineral oil.

According to one aspect the gas and vapours so generated by the thermal gasification process are collected by providing a gas riser tubing between the production facility and the subterranean formation such that an end of said tubing enters the accumulating gas/vapour head space above the oil to provide for gas recovery to the surface production facility.

According to another aspect the gas and vapours so generated by the thermal gasification process are allowed to accumulate above the mineral oil to build pressure, and the mineral oil is collected by providing a production riser tubing between the surface production facility and the subterranean formation such that an end of said tubing penetrates the oil to a sufficient depth to permit oil recovery to the surface production facility.

The latter thermal gasification process is suitable for use in recovery of oil when the formation beneath the oil is substantially impermeable to oil, and the formation above the oil is not significantly permeable to gas generated. Those skilled in the art will recognise that if the formation beneath the oil is permeable to oil to any significant extent oil may be driven further into the permeable formation, and that if the "overhead" formation is porous gas generated will simply leak away into the formation. Therefore, those skilled in the art will normally survey and assess the formation and thereafter exercise judgement as to which process according to the present invention is suited to the formation surveyed for oil recovery purposes, or whether an alternative approach needs to be considered. Other factors that those of appropriate experience and skill in this field will take account of is the quality of the oil to be recovered. Heavy crude oil containing high molecular weight paraffins and waxes at significant levels may not be suitable for the purposes of this invention.

Further according to the invention there is provided an apparatus for recovery of oil and/or gas by a process involving an in situ gasification of mineral oil in a subterranean formation which comprises a tool having a controllable thermal device, controllable means for launching (and optionally subsequently recovering the tool) from a surface production facility down to the subterranean formation, logging means for determining the location of the tool in relation to its operational proximity to the mineral oil in said subterranean formation, and at least one riser tubing for the selective recovery of mineral oil, or gaseous or vaporised products from said mineral oil.

The invention further provides a tool for use in gasification of mineral oil in situ in a subterranean formation, said tool comprising a thermal device selected from a spark igniter, an electrically heated coil, an electromagnetic heating device, a pyrotechnic charge with corresponding ignition device, an electrode arc ignition device, and a resistive heating element.

BRIEF DESCRIPTION OF THE DRAWINGS

The invention will now be further described with reference to the accompanying drawings in which.

MODES FOR CARRYING OUT THE INVENTION

In a gasification reaction as contemplated in the performance of the invention, the following gas generation reactions will be mainly observed in a typical case.

$$C+H_2O \rightarrow CO+H_2$$

$$CO+H_2O \rightarrow CO_2+H_2$$

$$C_pH_q+H_2O \rightarrow pCO+qH_2$$

$$CO_2+C \rightarrow 2CO$$

$$CH_4+H_2O \rightarrow CO+3H_2$$

$$CH_4+CO_2 \rightarrow CO_2+H_2$$

Figure 1:
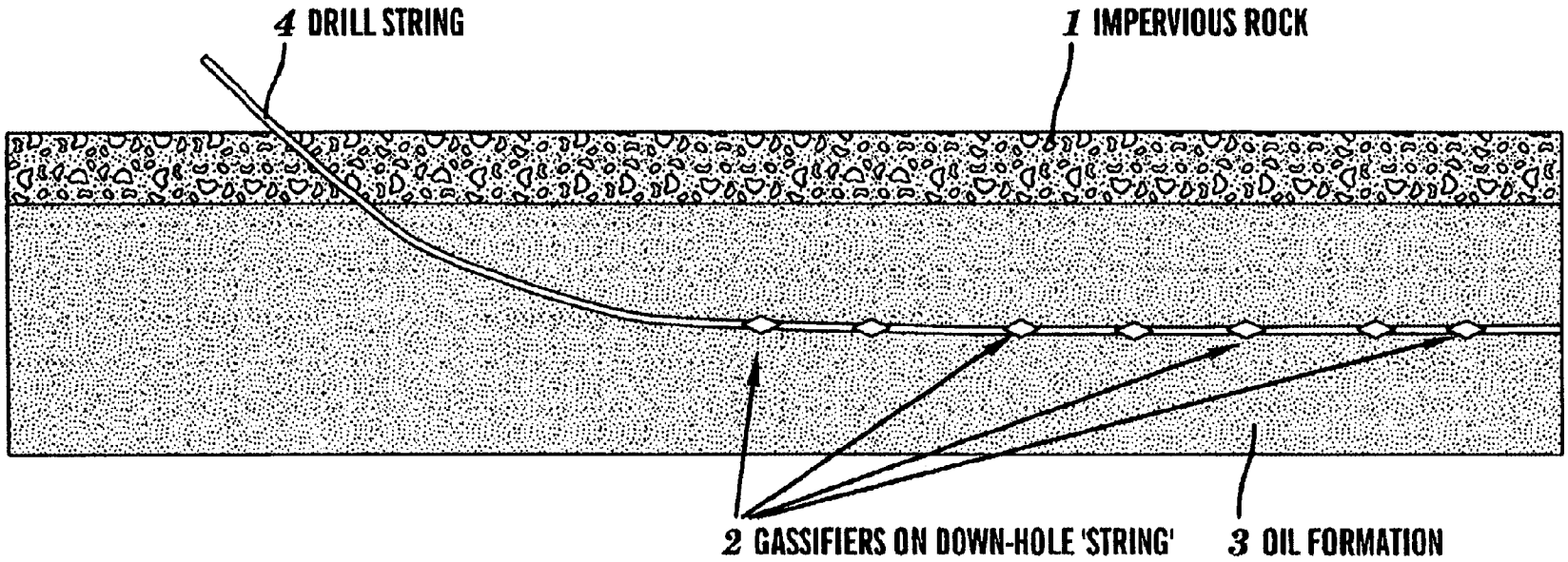
FIG. 1 illustrates a section through a subterranean residual oil-bearing formation into which a down-hole string equipped with devices for achieving gasification penetrates to provide a GPP facility.

In a gasification process to be conducted within a hydrocarbon-containing formation 1 according to the invention, as schematically illustrated in FIG. 1, devices 2 for causing a gasification event are arranged upon a string 4 adapted for down-hole work, and the string is either loaded into an existing bore hole or if necessary the string is equipped to drill its own passage through the formation. Its position is monitored and when it has penetrated a zone in a reservoir 3 containing hydrocarbon to be recovered or converted to gas, the devices are activated to initiate a gasification process.

In one proposal according to the present invention, an electrically powered resistive heating element 2 is brought into contact with the residual oil in the reservoir 3 and activated to raise the temperature to up to about 1000° C. A riser tubing (not shown) juxtaposed to the heating element permits vaporised oil and gaseous products to be collected. As the vapour gas mixture develops, there will be a corresponding development of a pressure and volume increase which on account of the presence of the riser tubing permits gas to readily pass up the tubing. The removal of produced gas leads in turn to more oil being drawn into the vicinity of the heater element for it in turn to be converted to gas which is removed as before. Ultimately the amount of oil that can be recovered efficiently by this method diminishes.

An enhanced oil recovery method is preferred because the crude oil is considered more valuable than the cracked pyrolysis gases/oil vapours, which may have limited utility. In other words, the crude oil may present greater marketing opportunities than the lower value gas commodity. On the other hand, a subterranean in situ oil-to-gas conversion approach provides a cleaner product output, which offers distinct environmental safeguards by obviating risks of crude spillage at the production well.

Figure 3:
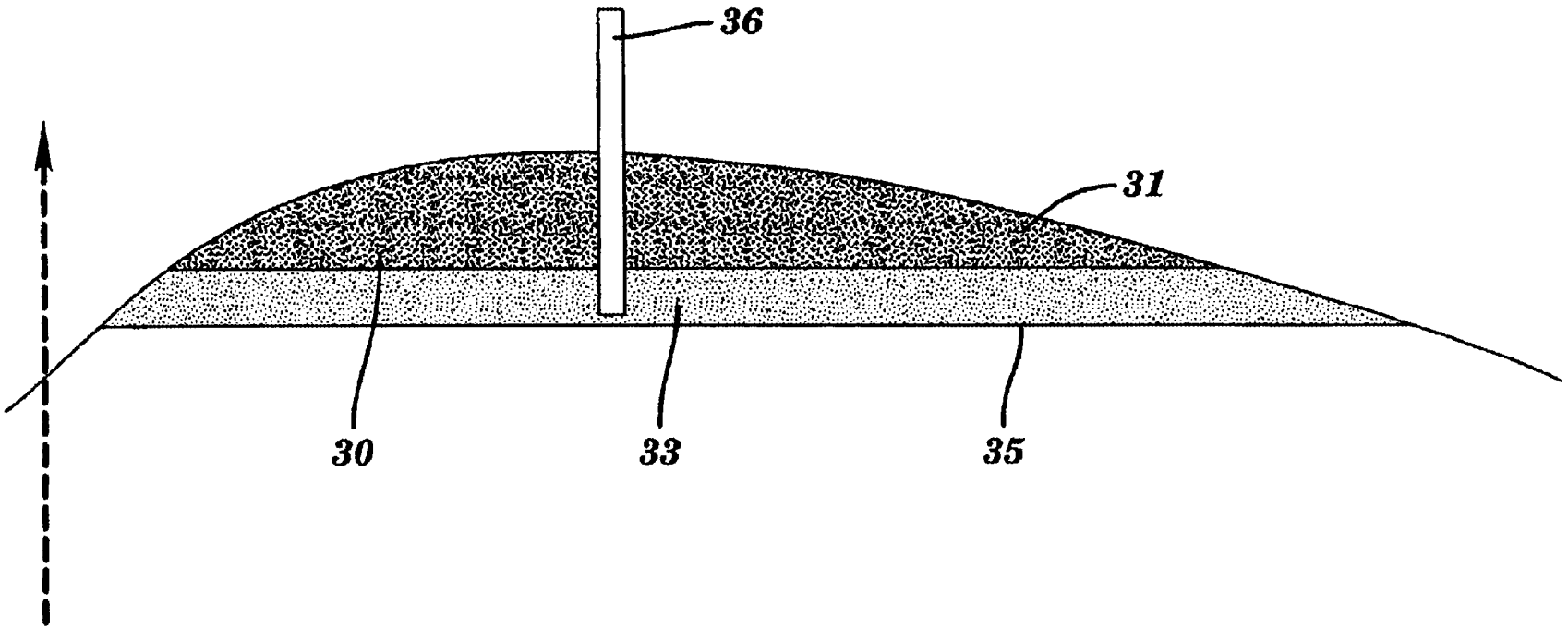
FIG. 3 illustrates schematically an EOR facility.

An EOR process is schematically illustrated in FIG. 3, where in an oil bearing formation 31, a volume of gas is provided over the crude oil in the reservoir 33, and this gas cap 30 produces an oil producing effect due to upward pressure upon the crude oil by formation water 35, and downward pressure of the produced gas. The net effect here is to maintain pressure with gas generated from the oil, which reduces the need to provide lift by injecting water to the formation, and moreover, produces both oil and gas rather than oil contaminated with water which complicates the production process.

In such a proposal according to the present invention, a process for recovery of oil according to the invention involves the use of a heating element deployed to directly heat the oil contained in the target formation. The heat generated by the heating element pyrolyses the oil to generate a syngas, which as the process progresses compensates for the low natural drive or depleted drive of the formation. Typically, an electrically powered resistive heating element is brought into contact with the residual oil in the reservoir and activated to raise the temperature to up to about 1000° C. As the vapour gas mixture develops, there will be a corresponding development of a pressure and gas volume increase standing over the oil. The increase in pressure upon the oil enables enhanced recovery thereof. A riser tubing 36 suitably presented to the oil allows the oil to be recovered under the pressure of the vaporised oil and gaseous products generated around the heating element and accumulating over the oil. The removal of oil leads in turn to more oil being drawn into the vicinity of the heater element for it in turn to be converted to gas, which accumulates and maintains pressure as before. At some point, this method too will reach a point where the amount of oil recoverable diminishes to uneconomic levels. However, since the methods of this invention are likely to be considered for low drive or depleted fields where other methods of recovery are already considered uneconomic, the advantages of the invention are readily apparent.

Figure 4:
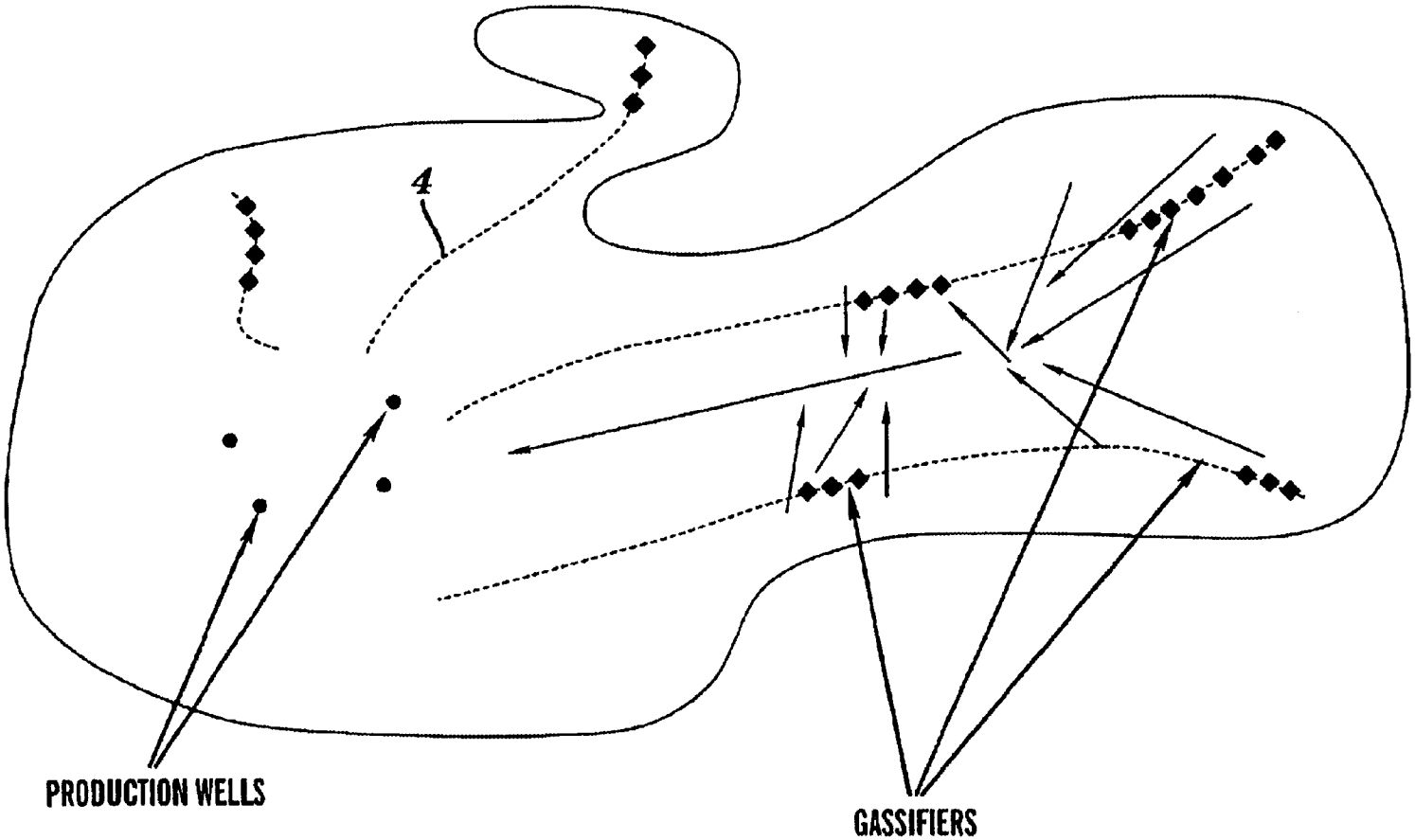
FIG. 4 illustrates in plan view an arrangement of strings equipped with devices for achieving gasification to drive an EOR facility.

As shown in FIG. 4, strategic deployment and positioning of the gasification devices on a drill string (4 strings are illustrated) can produce pressure differences across the entire reservoir that would preferentially displace oil from regions of low permeability and drive it towards the production wells in a more controllable manner than is currently achievable with existing EOR technology.

Figure 2:
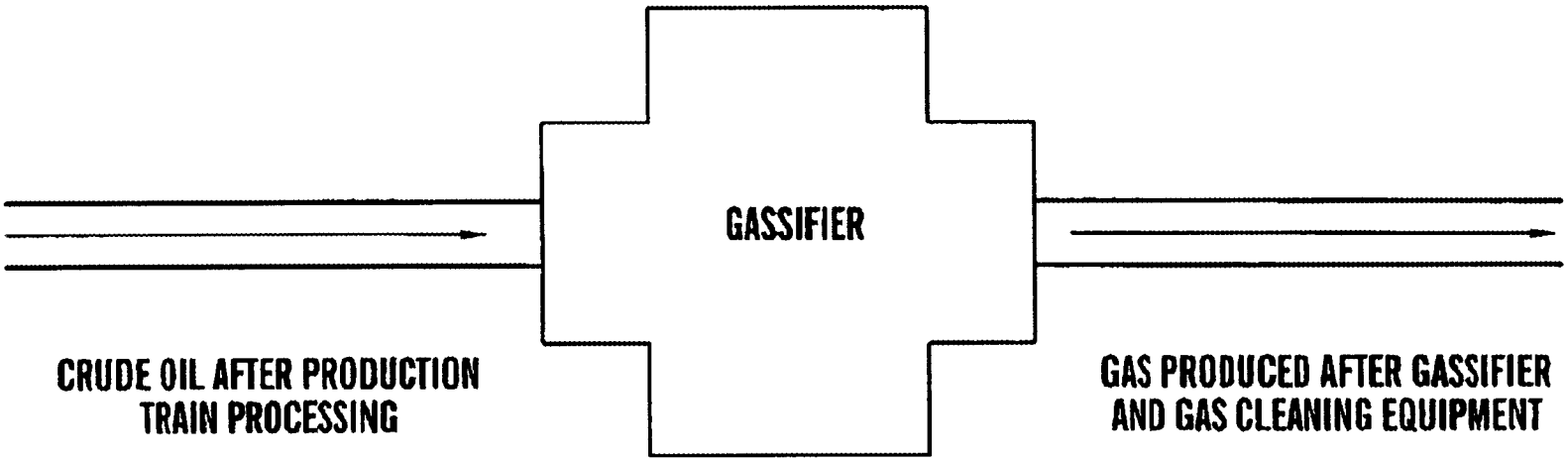
FIG. 2 illustrates schematically a surface gasification facility.

According to a further proposal according to the invention, oil recovered is subjected to a gasification process in a surface facility and the gas is either transported to a storage or distribution network (shown schematically in FIG. 2), or injected back into the formation to facilitate enhanced oil recovery (not shown).

Such a surface facility may use a steam reformation gasification process that would produce a very clean synthetic gas, which would be comparable to natural gas. Suitable gas cleaning equipment associated with the gasification equipment would remove any condensable materials for re-processing. This would reduce contamination that may be present in the pipeline and hence minimise the risks of possible environmental impacts in the event of pipeline failure.

A particularly significant advantage is observed here in that the production of oil and transportation of the hydrocarbons obtained therefrom as gas, enables recovery of a valuable resource from environmentally sensitive areas from which production is currently restricted or prohibited due to environmental concerns over the hazards associated with pipeline emissions of crude oil which is devastating upon local marine flora and fauna.

Syngas is a mixture of hydrogen, carbon monoxide and dioxide with 0% to low concentrations of hydrocarbon gases. The gas can be converted by the Fischer-Tropsch process utilising specialist catalysts to obtain synthetic hydrocarbons "synfuels". However, the use of synthesis processes to produce fuels is not widely practised. Only in Africa has such a synthesis process been applied industrially, relying on coal as the natural resource to start the process.

A synthesis gas plant will convert natural gas into syngas at a rate of up to 4 times the volume of syngas per volume of methane (after allowance for methane recycle, extraction of some hydrogen for refining and fuel gas for process requirements. A four-fold increase in volume of gas produced means a four-fold reduction in the volume of oil required for gasification. Thus for a low producing field of only some 1000 bbl (158987 litres) per day, it is estimated that only about 3.32 bbl (527.8 litres) per hour of oil need be gasified to syngas. Taking account of current oil prices (Arabian light) and natural gas costs, the processes proposed herein are economically feasible.

A significant advantage of the invention is to be found in the fact that by producing gas from oil, a cleaner product is obtainable. This means that in a comparison with an oil distribution network, where there is a risk of oil spillage from a fractured pipe or damaged union, a similar event in a gas line causes only gas escape, without the attendant environmental clean-up operations that inevitably follow an oil spillage.

What is claimed is:

1. A process for downhole gasification of oil in a subterranean formation which comprises running a tool having a controllable gasification device therein from a surface production facility down to the subterranean formation, bringing said tool into operational proximity with the oil in said subterranean formation, and activating the tool to operate the gasification device in the presence of water within a predetermined temperature range to generate the gases $H_2$, CO, and $CO_2$, and wherein oil recovered is subjected to a gasification process in a surface facility.

2. A process according to claim 1, wherein the gases generated by the gasification process are collected by providing a gas riser tubing between the production facility and the subterranean formation such that an end of said tubing enters accumulating gas in a head space above the oil to provide for gas recovery to the surface production facility.

3. A process according to claim 1, wherein the gases generated by the gasification process are allowed to accumulate above the oil to build pressure, and the oil is collected by providing a production riser tubing between the surface production facility and the subterranean formation such that an end of said tubing penetrates the oil to a sufficient depth to permit oil recovery to the surface production facility.

4. A process according to claim 1, wherein gas obtained from the gasification process in the surface facility is injected back into the formation to facilitate enhanced oil recovery.

5. A process for recovery of oil and/or gas by downhole gasification of mineral oil in a subterranean formation in the presence of water to generate the gases $H_2$, CO, and $CO_2$ which comprises deploying upon a drill string a gasification tool having a controllable gasification device, controllably launching the tool from a surface production facility down to the subterranean formation, determining the location of the tool in relation to its operational proximity to the mineral oil in said subterranean formation, providing at least one riser tubing for the selective recovery of mineral oil, or gaseous or vaporised products from said mineral oil, and activating the gasification device to cause at least one of the following reactions:

$$C+H_2O \rightarrow CO+H_2$$

$$CO+H_2O \rightarrow CO_2H_2$$

$$C_pH_q+H_2O \rightarrow {}_pCO+{}_qH_2$$

$$CO_2+C \rightarrow 2CO$$

$$CH_4+H_2O \rightarrow CO+3H_2$$

$$CH_4+CO_2 \rightarrow CO_2+H_2$$

thereby accumulating gas pressure over mineral oil in the subterranean formation.

6. A process according to claim 5, wherein a plurality of gasification tools are deployed at selected positions upon a drill string.

7. A process according to claim 5, wherein several drill strings are used to deploy gasification tools in a selected pattern to achieve a controlled gasification front for driving oil towards a production facility.

8. A process according to claim 5, wherein oil is recovered by presenting a riser tubing to the oil and allowing accumulating gas pressure to drive the oil into the riser tubing.

9. A process according to claim 5, further comprising subsequently recovering the tool from the subterranean formation.

10. A process for recovery of oil and/or gas by downhole gasification of mineral oil in a subterranean formation in the presence of water to generate the gases $H_2$, CO, and $CO_2$ which comprises deploying upon a drill string a gasification tool having: a controllable gasification device, controllable means for launching the tool from a surface production facility down to the subterranean formation, logging means for determining the location of the tool in relation to its operational proximity to the mineral oil in said subterranean formation, and at least one riser tubing for the selective recovery of mineral oil, or gaseous or vaporised products from said mineral oil; and activating the gasification device to cause at least one of the following reactions:

$$C+H_2O \rightarrow CO+H_2$$

$$CO+H_2O \rightarrow CO_2+H_2$$

$$C_pH_q+H_2O \rightarrow {}_pCO+{}_qH_2$$

$$CO_2+C \rightarrow 2CO$$

$$CH_4+H_2O \rightarrow CO+3H_2$$

$$CH_4+CO_2 \rightarrow CO_2+H_2,$$

thereby accumulating gas pressure over mineral oil in the subterranean formation.

11. A process according to claim 5, wherein activating the gasification device causes all of said reactions.

12. A process according to claim 10, wherein activating the gasification device causes all of said reactions.

* * * * *